US009057042B2

(12) United States Patent
Davis et al.

(10) Patent No.: US 9,057,042 B2
(45) Date of Patent: Jun. 16, 2015

(54) PRETREATMENT CUP

(71) Applicant: The Procter & Gamble Company, Cincinnati, OH (US)

(72) Inventors: William John Davis, Bath (GB); David James McNeill, Bath (GB); Pieter Paul Dirk Jenny Maria Van Den Bergh, St. Martens Latem (BE); Katrien Andrea Tony Hellings, Hofstade (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/496,781

(22) Filed: Sep. 25, 2014

(65) Prior Publication Data

US 2015/0013078 A1 Jan. 15, 2015

Related U.S. Application Data

(62) Division of application No. 13/477,545, filed on May 22, 2012, now Pat. No. 8,870,485.

(30) Foreign Application Priority Data

May 23, 2011 (EP) ..... 11167093

(51) Int. Cl.

| | |
|---|---|
| ***C11D 17/04*** | (2006.01) |
| ***D06F 39/02*** | (2006.01) |
| ***D06F 35/00*** | (2006.01) |

(52) U.S. Cl.

CPC ..... *C11D 17/04* (2013.01); *D06F 39/024* (2013.01); *D06F 35/005* (2013.01)

(58) Field of Classification Search

USPC ..... 401/118, 123, 126, 129, 262, 269, 195, 401/202

See application file for complete search history.

(56) References Cited

U.S. PATENT DOCUMENTS

| | | | |
|---|---|---|---|
| 3,090,067 | A | 5/1963 | Weiby et al. |
| 3,107,388 | A | 10/1963 | Groves |
| 4,741,459 | A | 5/1988 | Silvenis et al. |
| 4,767,034 | A | 8/1988 | Cramer |
| 5,181,630 | A | 1/1993 | McNally |
| 5,228,596 | A | 7/1993 | McNally |
| 5,251,788 | A | 10/1993 | Moore |
| 5,355,541 | A | 10/1994 | Rutter et al. |
| 5,388,298 | A | 2/1995 | Rutter et al. |
| 5,549,209 | A | 8/1996 | Weissman et al. |

(Continued)

FOREIGN PATENT DOCUMENTS

| | | |
|---|---|---|
| DE | 200 04 275 U1 | 8/2000 |
| GB | 2 168 931 | 7/1986 |

(Continued)

OTHER PUBLICATIONS

International Search Report for International Application Serial No. PCT/US2012/038023, mailed Aug. 13, 2012, 10 pages.

Photographs of a dosing ball sold with a Henkel Persil Gold 1.5L bottle that was purchased in Sep. 2009.

U.S. Appl. No. 13/886,883, filed May 3, 2013, Fox et al.

*Primary Examiner* — David Walczak

(74) *Attorney, Agent, or Firm* — Gary J. Foose

(57) ABSTRACT

A method of laundering fabrics that is intuitive for the customer, ensures good penetration of the liquid laundry detergent composition into a stain, particularly greasy stain, and is suitable for washing delicate fabrics, particularly at low temperatures.

18 Claims, 10 Drawing Sheets

(56) References Cited

U.S. PATENT DOCUMENTS

| | | | |
|---|---|---|---|
| D382,482 | S | 8/1997 | Lathrop et al. |
| 6,353,954 | B1 | 3/2002 | Dunsbergen et al. |
| 6,739,781 | B2 | 5/2004 | Maloney et al. |
| 6,874,190 | B2 | 4/2005 | Deflander et al. |
| 7,425,102 | B1 | 9/2008 | Velliquette |
| D689,364 | S | 9/2013 | Sanders |
| D701,120 | S | 3/2014 | Sanders |
| 2003/0198502 | A1 | 10/2003 | Maloney et al. |
| 2009/0014465 | A1 | 1/2009 | De Wree et al. |
| 2009/0045224 | A1 | 2/2009 | Faaborg et al. |
| 2011/0162151 | A1 | 7/2011 | Chawla et al. |
| 2011/0179585 | A1 | 7/2011 | Chawla et al. |
| 2011/0179586 | A1 | 7/2011 | Chawla et al. |
| 2011/0179587 | A1 | 7/2011 | Wilkins et al. |
| 2011/0311296 | A1 | 12/2011 | Chawla et al. |
| 2012/0297552 | A1 | 11/2012 | Davis et al. |
| 2012/0298543 | A1 | 11/2012 | Davis et al. |
| 2014/0001071 | A1 | 1/2014 | Sanders et al. |

FOREIGN PATENT DOCUMENTS

| | | | |
|---|---|---|---|
| GB | 2 349 649 | | 11/2000 |
| JP | 11-244770 | A | 9/1999 |
| WO | WO 98/16148 | A1 | 4/1998 |
| WO | WO 98/16438 | A1 | 4/1998 |
| WO | WO 00/20676 | A1 | 4/2000 |
| WO | WO 01/23295 | A2 | 4/2001 |
| WO | WO 02/16686 | A1 | 2/2002 |
| WO | WO 2004/112538 | A1 | 12/2004 |
| WO | WO 2008/135953 | A1 | 11/2008 |
| WO | WO 2010/012552 | A1 | 2/2010 |

PRETREATMENT CUP

FIELD OF THE INVENTION

The present invention relates to a pretreatment cup for improved pretreating of fabric stains.

BACKGROUND OF THE INVENTION

Many of today's liquid laundry detergent compositions are formulated to deliver superior removal of grease, soils, and other stains. However, many customers still prefer to use specialist pretreat compositions, even though liquid laundry detergent compositions are often formulated for pretreating stains.

A big cause for this customer behaviour is that dosing devices, typically sold with liquid laundry detergent compositions, are less than satisfactory for use in pretreating, except for light and non-greasy stains. The dosing devices are often also not intuitive to use, with many customers not even being aware that they can be used for pretreating stains. Even if the customer does pretreat stains using the liquid detergent composition, the customer will typically pour a small amount of the liquid detergent composition onto the fabric, before rubbing, either with another part of the fabric, or with the dosing device. The result is that while a portion of the liquid detergent composition that is used for pretreating penetrates the fabric stain, a significant proportion is pushed over the fabric and away from the stain. This results in much of the liquid laundry detergent composition that is intended for pretreating, not penetrating all of the fabric stain, but instead being transferred to unstained regions that do not require pretreating. This is particularly a problem for stains such as grease, where the hydrophobic nature of the stain makes it even more difficult for the liquid detergent composition to penetrate the fabric. The result is less than desired stain removal, particularly at low temperatures, since much of the stain removing actives are not able to work directly on the stain during pretreating. In addition, the heavy scrubbing that is generally required to ensure good liquid laundry detergent penetration into stains, particularly greasy stains, can damage the surface of delicate fabrics. Consequently, customers rarely use current dosing devices for pretreating delicate fabrics such as silks and rayon.

Therefore, a need remains for a pretreating device, and method, that is intuitive for the customer, ensures good penetration of the liquid laundry detergent composition into a stain, particularly greasy stains, and is suitable for washing delicate fabrics, particularly at low temperatures.

U.S. Pat. No. 5,549,209 discloses a closure for a liquid laundry detergent container having an integrated brush, U.S. Pat. No. 5,388,298 discloses a dispenser with an integrated scrubbing surface and pretreat nozzle, U.S. Pat. No. 4,767,034 discloses a cap to a spray bottle having an integrated scrubber. U.S. Pat. No. 6,874,190 discloses a hand-held container for washing laundry. U.S. Pat. No. 5,181,630 discloses a cap having a pouring spout. GB 2 168 931 discloses a cap having an applicator.

SUMMARY OF THE INVENTION

The present invention relates to a pretreatment cup (10) comprising: a base comprising an exterior base surface (50); a wall comprising an exterior wall surface (60); and an opening (40) circumscribed by a rim (170), wherein the opening is at least partially opposite the base; wherein the exterior base surface (50) is connected to the exterior wall surface (60) at an exterior periphery (70); characterized in that: a surface selected from the group consisting of: the exterior base surface (50), the exterior wall surface (60), and mixtures thereof, comprises a spreading region (80), wherein the spreading region (80) comprises one or more spreading protrusions (90), wherein the spreading protrusions (90) have an orientation selected from the group consisting of: radial, concentric, spiral, or mixtures thereof.

DETAILED DESCRIPTION OF THE INVENTION

It has been discovered that a spreading region (80), that comprises spreading protrusions (100) which are oriented radially, concentrically, spirally, or a mixture thereof, can be used to uniformly spread a liquid laundry detergent uniformly over a stain, thereby achieving improved stain removal during pretreating, even during low temperature washing, and even for hydrophobic stains. In addition, such pretreatment methods require less scrubbing and are thus, more suitable for delicate fabrics.

When referring to a pretreatment cup, all percentages, ratios and proportions used herein are by weight percent of the pretreatment cup, unless otherwise specified. When referring to a liquid detergent composition, all percentages, ratios and proportions used herein are by weight percent of the liquid detergent composition, unless otherwise specified. The term "dose", unless indicated otherwise, is defined as a measured amount of liquid to be delivered from a container, cup, or other suitable device. Preferably, the dose is measured using the pretreatment cup.

Figure 1:
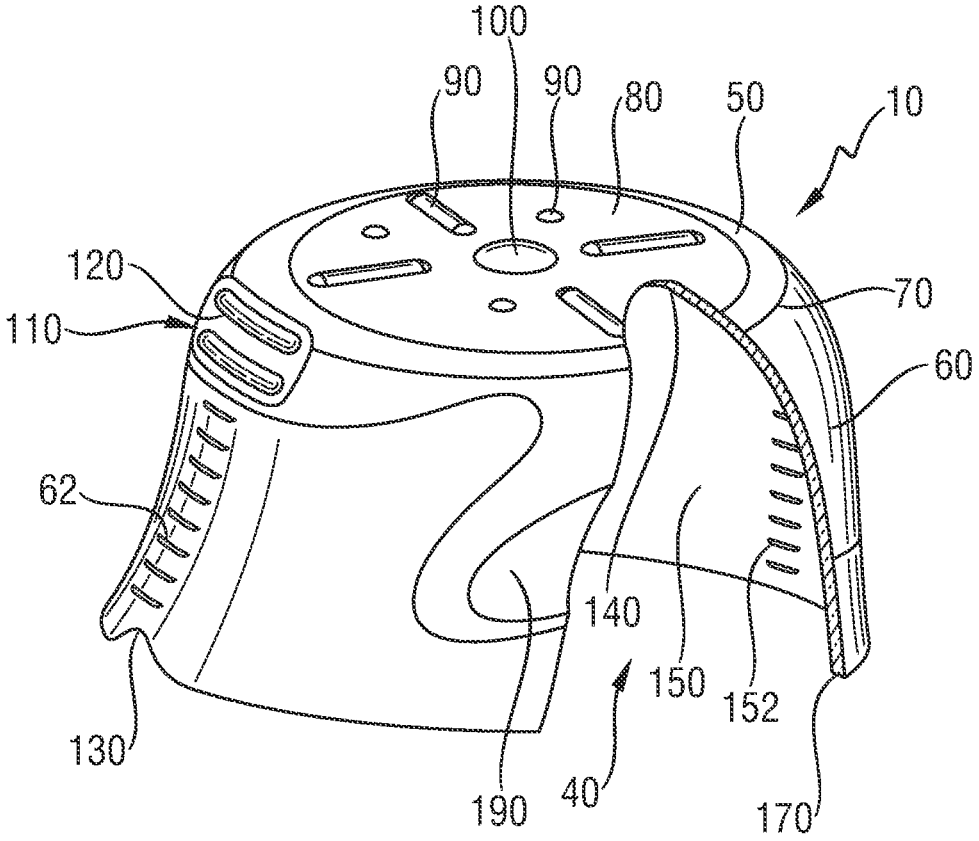
FIG. 1 illustrates an embodiment of the pretreatment cup (10), with the exterior base surface (50) oriented towards the top.
Figure 2:
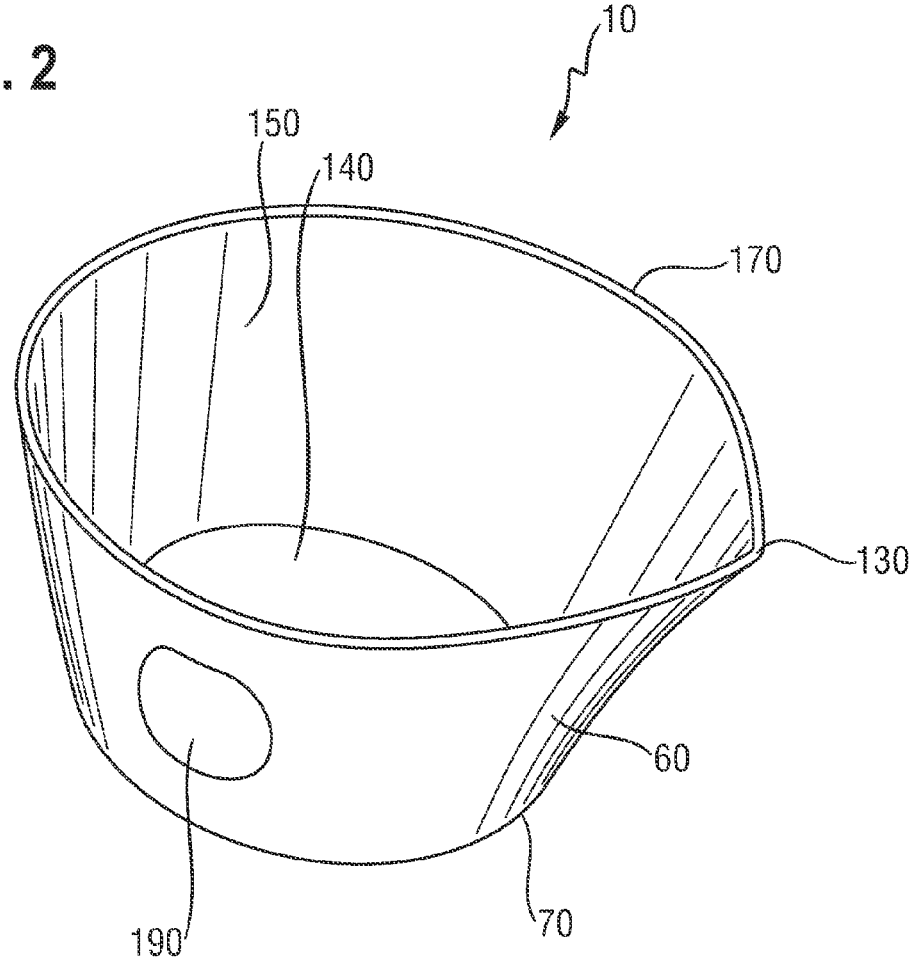
FIG. 2 illustrates an embodiment of the pretreatment cup (10), with the opening (40) oriented towards the top.
Figure 3A:
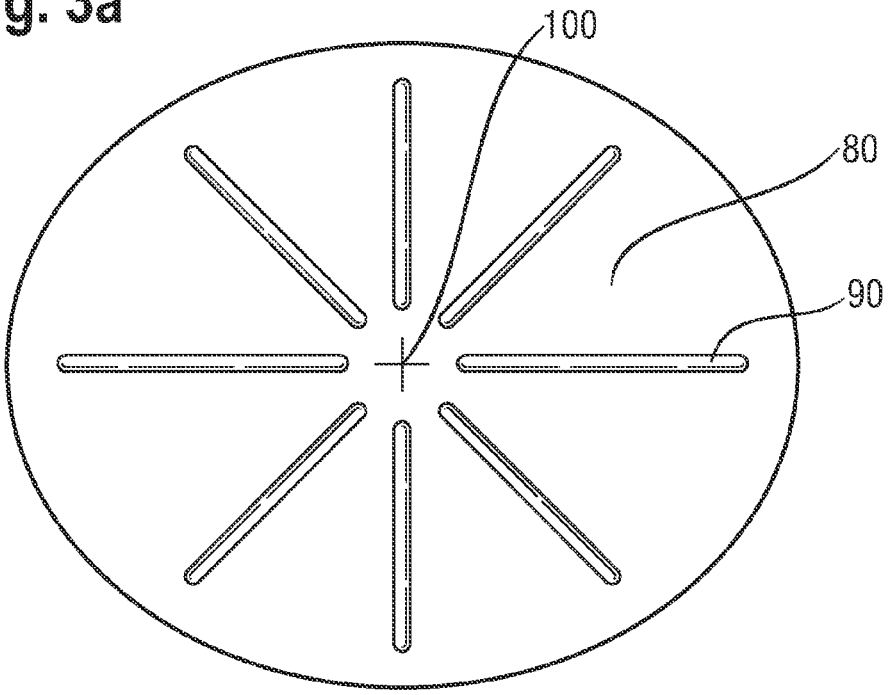
FIG. 3*a* illustrates a top view exemplifying a spreading region (80) comprising spreading protrusions (90) in the form of straight lines, radiating from a central point (100), which is located at the centre of the spreading region (80).
Figure 3B:
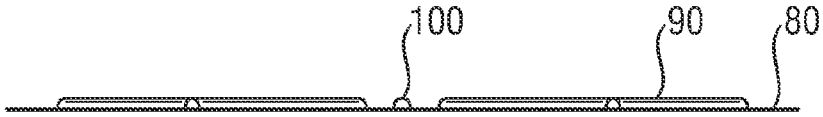
FIG. 3*b* illustrates a side view exemplifying the spreading region (80), of FIG. 3*a*.

The Pretreatment Cup:

The pretreatment cup (10) comprises a base, an exterior wall, and an opening (40) that is circumscribed by a rim (170). The opening (40) is at least partially opposite the base. The outer surface of the pretreatment cup is made up of an exterior base surface (50) connected to an exterior wall surface (60) at an exterior periphery (70). The pretreatment cup (10) may also comprise an interior base surface (140) and an interior wall surface (150), preferably at least partially connected together at an interior periphery. The pretreatment cup (10) also comprises a spreading region (80) and optionally a scrubbing region (110). Such a pretreatment cup is exemplified in FIG. 1 and FIG. 2.

The pretreatment cup (10) can be any suitable size. For stability, the base will typically have an area of from 300 $mm^2$ to 8,000 $mm^2$, preferably from 900 $mm^2$ to 5,600 $mm^2$, most preferably from 1,900 $mm^2$ to 3,800 $mm^2$. As such, the width of the base will typically range from 20 mm to 100 mm, preferably 35 mm to 85 mm, most preferably from 50 mm to 70 mm. For easy filling, the opening (40) will typically have an area of from 700 $mm^2$ to 9,500 $mm^2$, preferably from 1,500 $mm^2$ to 7,000 $mm^2$, most preferably from 2,500 $mm^2$ to 5,000 $mm^2$. As such, the width of the opening (40) will typically range from 30 mm to 110 mm, preferably 45 mm to 95 mm, most preferably from 60 mm to 80 mm. The wall will typically have a height from 20 mm to 85 mm, preferably from 35 mm to 70 mm.

The exterior base surface (50) can be connected to the exterior wall surface (60) at the exterior periphery (70) at any angle, including 90°. Additionally, the exterior periphery (70) preferably comprises a curvature from the exterior base surface (50) to the exterior wall surface (60). Preferably, the radius of curvature at the exterior periphery (70) is from 2 mm to 35 mm, more preferably from 3.5 mm to 25 mm, most preferably from 5 mm to 15 mm. A curvature is particularly preferred if the pretreatment cup (10) comprises a scrubbing region (110) that is at least partially located at the exterior periphery (70).

The base, the wall, or both the base and the wall of the pretreatment cup (10) can be a single layer of material, such as high density polyethylene or polypropylene, a multilayered material, or any other material having sufficient structural integrity to be used as a pretreatment cup (10), and preferably also as a dosing device for dosing the liquid detergent composition into a washing machine. Preferably, the base, the wall, or both the base and the wall of the pretreatment cup (10) comprise polypropylene, for improved resistance to wear during pretreating and during wash cycles.

The exterior base surface (50) can provide a surface arrangement that can be stably set upon another surface that is substantially flat as measured on a scale of centimetres, such as a table or a flat portion of a washing machine or dryer. In a preferred embodiment, the exterior base surface (50) can be essentially flat, or have a slight curvature, such that the cup (10) can be stably placed on a flat surface. With such a configuration, when liquid detergent composition is poured into the pretreatment cup (10), the cup (10) will not easily tip over as detergent composition is poured into the pretreatment cup (10).

The pretreatment cup (10) can be provided with one or more indicia. The indicia are preferably located on a surface selected from the group consisting of: the interior wall surface (150), the exterior wall surface (60), and mixtures thereof. Preferably, the interior wall surface (150) is provided with one or more interior indicia (152). It is particularly preferred that the exterior wall surface (60) is provided with one or more exterior indicia (62), when at least part of the wall is translucent or transparent. To facilitate easier measuring, both the interior wall surface (150) and exterior wall surface (60) can be provided with indicia. The indicia can be an etch, a depression, a raised portion, printing, or any other structure that is observable by the user.

The indicia can indicate the recommended dosage of liquid detergent composition to be poured into the pretreatment cup. Preferably, the indicia indicate the recommended dosages for a usage selected from the group consisting of: stain pretreating, average duty wash conditions, light duty wash conditions, heavy duty wash conditions, and mixtures thereof. Light duty wash conditions, typically consist of lightly soiled loads and low water hardness (from 50 mg/l to 125 mg/l of $CaCO_3$). Average duty wash conditions typically consist of moderately soiled loads and average water hardness (from 126 mg/l to 250 mg/l of $CaCO_3$). Heavy duty wash conditions typically consist of heavily soiled loads and high water hardness (greater than 250 mg/l of $CaCO_3$.

The pretreatment cup can also comprise a means for attachment to a liquid detergent composition container, preferably to the container cap. Suitable means include a clip, a screw thread, or a push-fit mechanism. In one embodiment, the interior base surface (140) of the pretreatment cup (10) comprises the first part of an attachment system, and the cap exterior top surface (310) of a cap (300), comprises a second part of an attachment system, wherein said attachment system comprises a cooperating attachment protrusion (200) and attachment channel (320). Alternatively, the pretreatment cap may also engage with a bottle to form a seal to close the container, hence forming a cap for the container.

The pretreatment cup may also comprise a spout (130), located on the rim (170). Preferably, the spout (130) is located vertically in line with the scrubbing region (110), if present, to make it easier to pour a small amount of liquid detergent composition onto a stain, spread the composition with the spreading region (80) and scrub with the scrubbing region (110) without the customer having to change his grip. Suitable spouts (130) include an outcrop from the rim (170) and wall, or may optionally comprise a hole in the wall, preferably close to the opening. In a preferred embodiment, the pretreatment cup (10) includes a baffle (180), adjacent to the spout (130). Such baffles (180) split the opening (40) into two or more sections comprising a fill opening (42) and a spout opening (44). The baffle (180) helps the customer to metre the required dose of liquid detergent composition onto the stain, without spilling excess liquid detergent composition.

The exterior wall surface (60) of the pretreatment cup (10) may also comprise a gripping region (190). The gripping region (190) may be selected from: an indented region, a raised region, a textured region, or a combination thereof. The gripping region (190) guides the customer to hold the pretreatment cup (10) is such a manner, that pouring the liquid detergent composition, spreading the liquid detergent composition, scrubbing with the liquid detergent composition, and mixtures thereof, become intuitive for the customer.

Spreading Region:

The pretreatment cup comprises a spreading region (80) located on a surface selected from the group consisting of: the exterior base surface (50), the exterior wall surface (60), and mixtures thereof. For ease of handling, the spreading region (80) is preferably at least partially located on the exterior base surface (50). Preferably, the spreading region (80) is located on the exterior base surface (50). The spreading region may be any suitable shape, though circular and oval shapes are preferred. While the spreading region may be flat, with the exception of the spreading protrusions (100), a small curvature is preferred for spreading the liquid detergent composition over the stained part of the fabric. In addition, a small curvature helps to smooth out the fabric and remove folds during pretreating. However, it is preferable that the curvature is not so great that the spreading region behaves partially like a wiper, such that the curvature wipes the liquid laundry detergent composition thinly or unevenly over the stain. Preferably, the spreading region (80) has a curvature such that when the pretreatment cup is positioned with the centre of mass of the spreading region (80) on a flat non-deformable surface (such as a table), the pretreatment cup can be tilted a maximum of 45°, preferably a maximum of 30°, more preferably a maximum of 15° before the spreading region is no longer in contact with the non-deformable surface. Preferably, the spreading region (80) has no sharp changes in curvature (such as a step). The centre of mass of the spreading region is calculated using the formula:

$$R = \frac{\int \rho(r) r dV}{\int \rho(r) dV} \quad (1)$$

Figure 4:
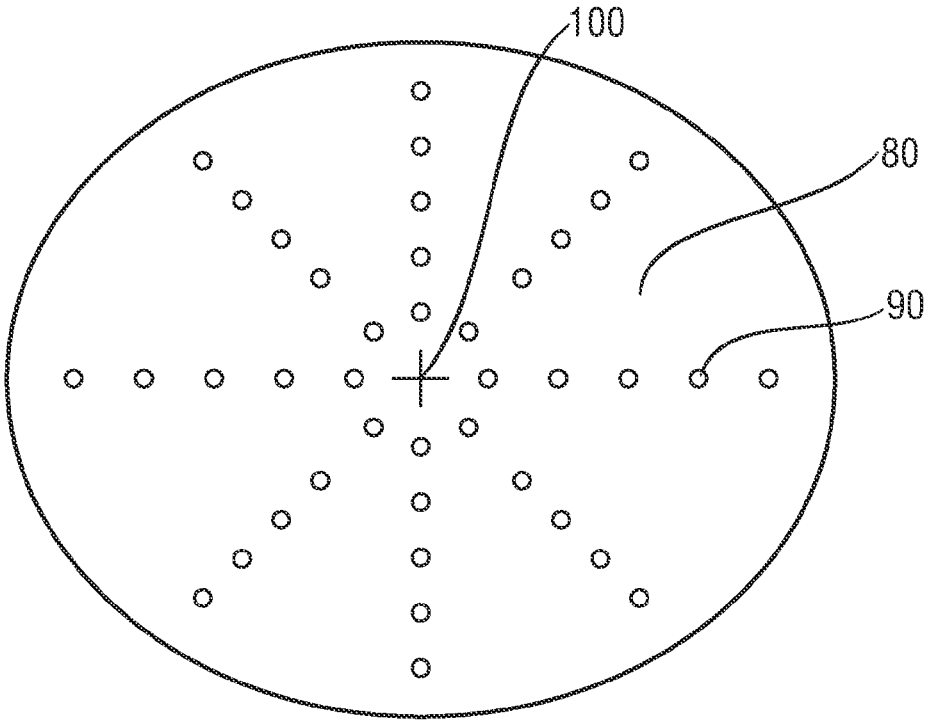
FIG. 4 illustrates a top view exemplifying a spreading region (80) comprising spreading protrusions (100) in the form of dots, radiating from a central point (100), which is located at the centre of the spreading region (80).
Figure 5:
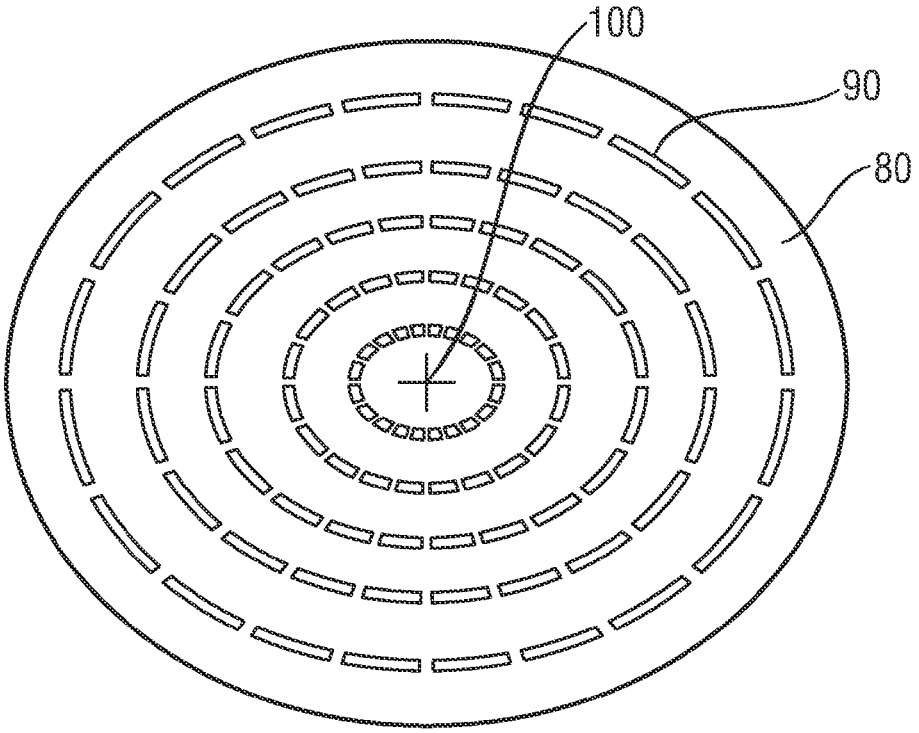
FIG. 5 illustrates a top view exemplifying a spreading region (80) comprising spreading protrusions (100) in the form of straight lines, oriented concentrically around a central point (100), which is located at the centre of the spreading region (80).
Figure 6:
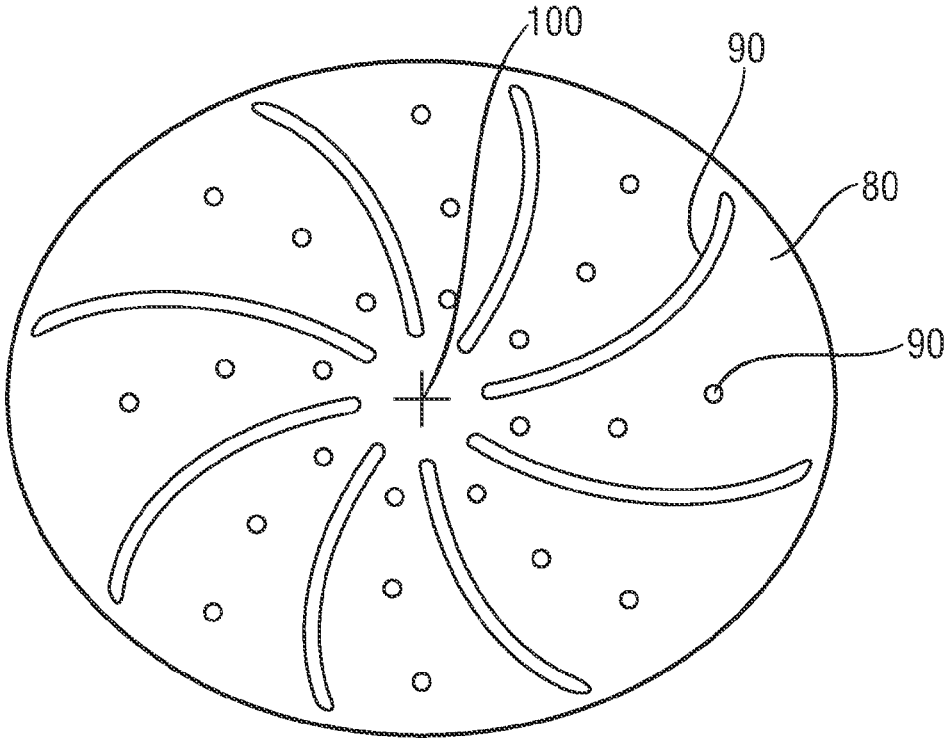
FIG. 6 illustrates a top view exemplifying a spreading region (80) comprising spreading protrusions (100) in the form of curved lines and dots, oriented spirally around a central point (100), which is located at the centre of the spreading region (80).
Figure 7:
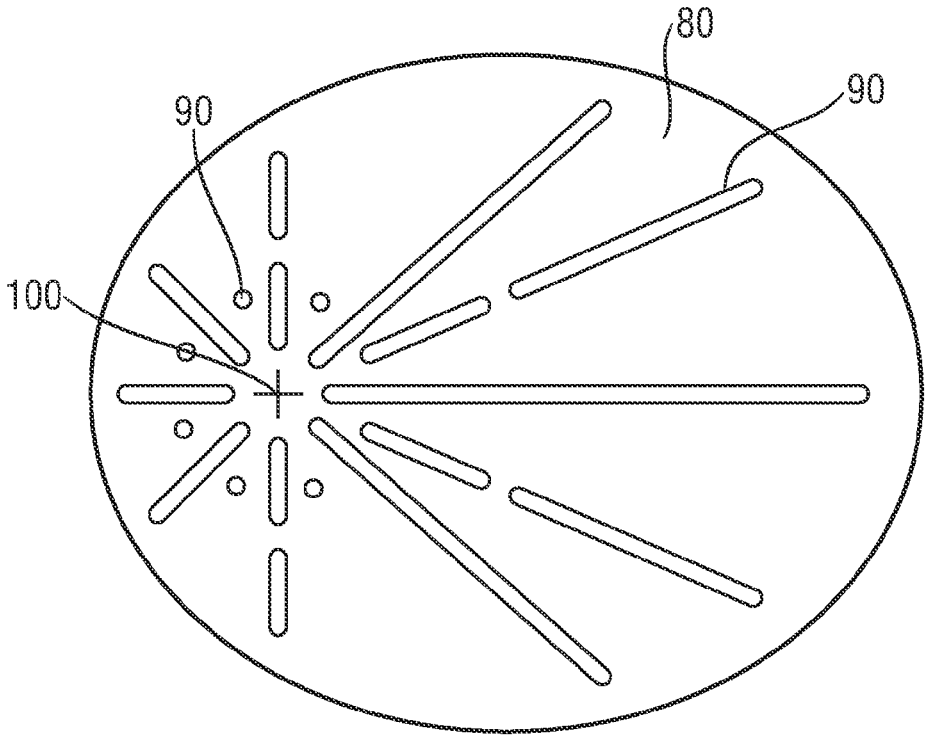
FIG. 7 illustrates a top view exemplifying a spreading region (80) comprising spreading protrusions (100) in the form of straight lines and dots, oriented radially around a central point (100), which is located to the left of centre of the spreading region (80).
Figure 8:
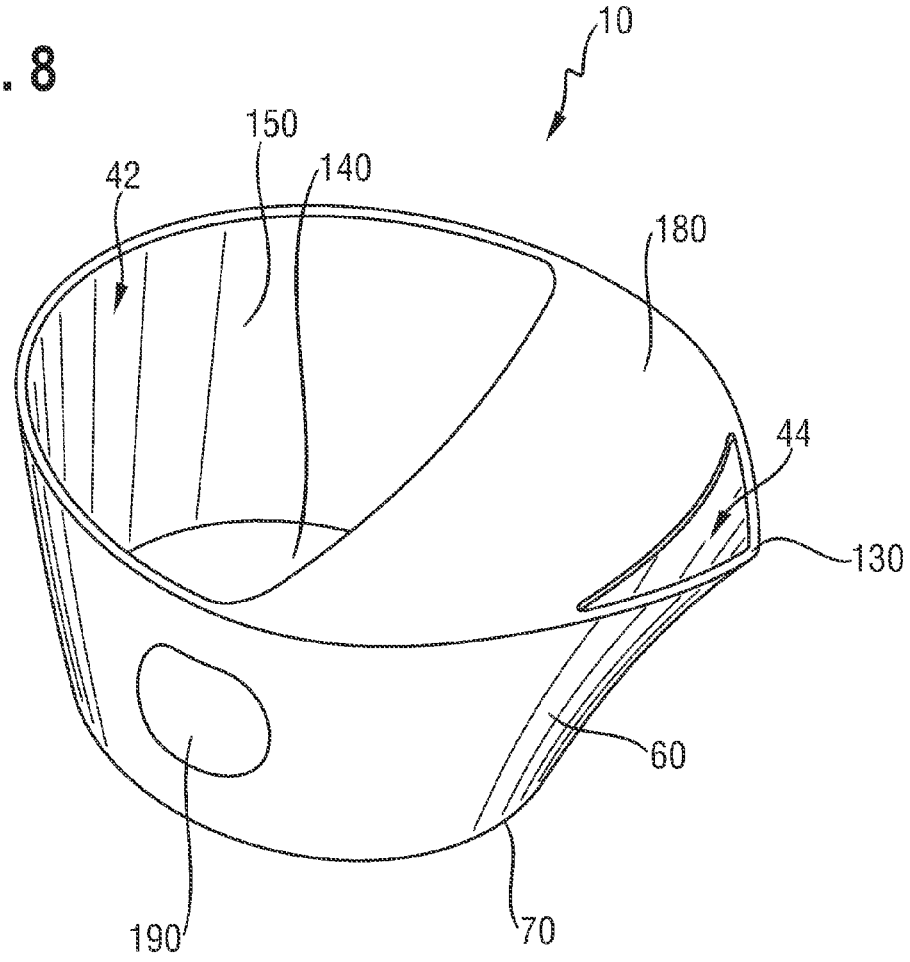
FIG. 8 illustrates an embodiment of the pretreatment cup (10), with the exterior base surface (50) oriented at the top, further comprising a baffle (180) which divides the opening into a fill opening (42) and a spout opening (44).
Figure 9:
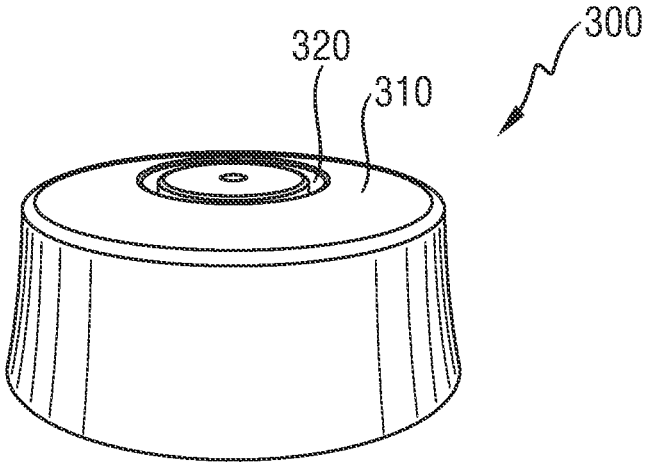
FIG. 9 illustrates a container cap (300) comprising a circular attachment channel (320) on the cap exterior top surface (310).
Figure 10:
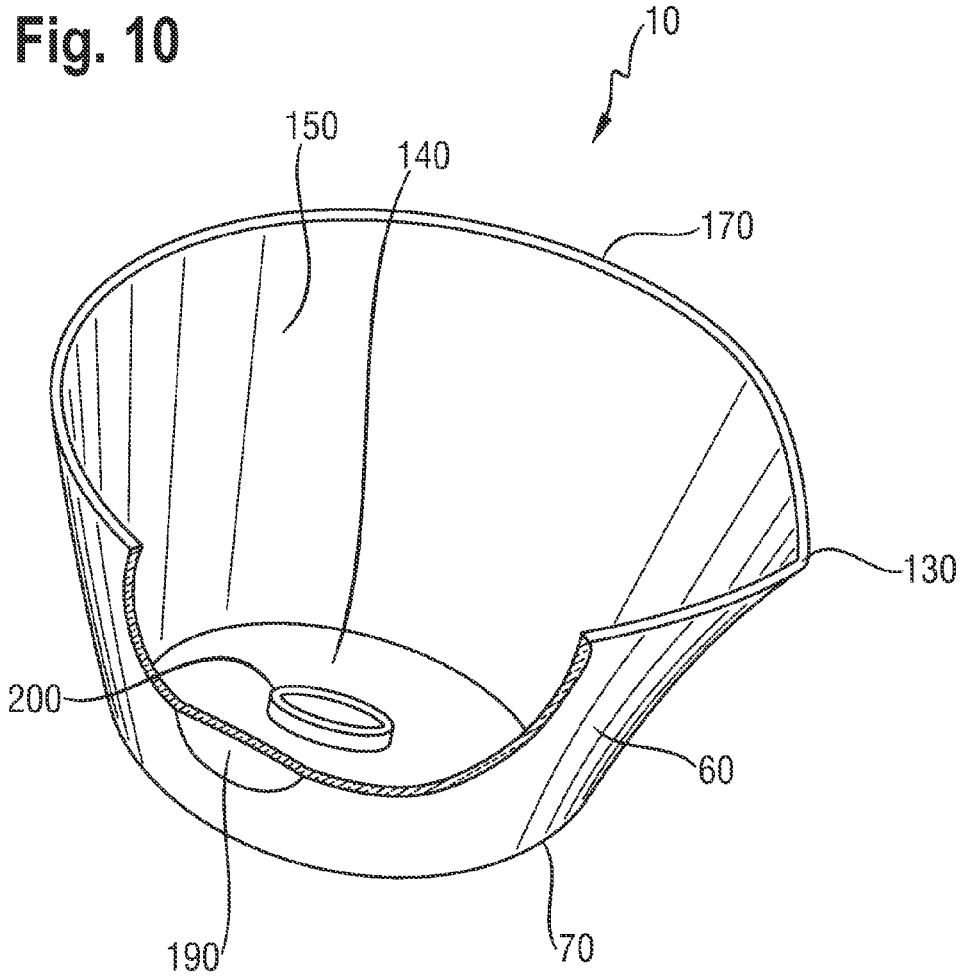
FIG. 10 illustrates an embodiment of a pretreatment cup (10), with the exterior base surface (50) oriented at the top, further comprising a ring-shaped attachment protrusion (200).

The spreading region (80) comprises 1 or more spreading protrusions (100). Preferably, the spreading region (80) comprises at least 2, more preferably at least 5 spreading protrusions (100). The spreading region (80) can comprise any number of spreading protrusions (90), though less than 50, preferably less than 40, more preferably less than 30 are preferred. The spreading protrusions (90) are preferably selected from the group consisting: of lines, dots, and mixtures thereof. If lines are present, they can be straight or curved. They can be from 2 mm to 40 mm, preferably from 3 mm to 25 mm, more preferably from 4 mm to 15 mm in length. The width of the lines can be from 0.2 mm to 4 mm, preferably from 0.5 mm to 3 mm, more preferably from 0.8 mm to 2 mm in width. The lengths are measured along the backbone of the line. Preferably, the lines do not connect to form a closed region. If dots are present, they can be any shape, but are preferably circular or oval in shape. The dots can have a width of from 0.2 mm to 5 mm, preferably from 0.5 mm to 4 mm, more preferably from 1 mm to 3 mm. Such spreading protrusions (90) do not result in the liquid laundry detergent composition being restricted under the spreading region, when the pretreatment cup is used for spreading the liquid detergent composition over a stain. Suitable lines are exemplified in FIGS. 3, 5, 6, and 7. Suitable dots are exemplified in FIGS. 4, 6, and 7.

The spreading protrusions (100) are arranged in a pattern selected from the group consisting of: radial, concentric, spiral, or mixtures thereof. A radial pattern is preferred. While the central point (100) of the pattern is preferably located at the centre of mass of the spreading region (80), the central point (100) of the pattern can be located at any suitable point on the spreading region (80). The resultant distribution of spreading protrusions (100) helps to gently distribute the liquid detergent composition uniformly over the stain.

For ease of manufacture, the spreading region, preferably including the spreading protrusions (100), can be made from one material. Preferably, the material comprises polypropylene. More preferably, the spreading region is made from polypropylene. However, in other embodiments, the spreading protrusions (100) can be made from a different material from the rest of the spreading region (80).

If the spreading protrusions (100) are too flexible, flicking of the liquid detergent composition may occur during use. Therefore, the spreading protrusions (100) preferably are made from a material having a hardness, as measured on the Rockwell scale (ISO 2039-2), of from 50 to 150. The spreading protrusions (100) are made from a material having a hardness that is more preferably from 60 to 100, and most preferably from 65 to 85. For a similar reason, it is preferred that the spreading protrusions (100) have a height from the exterior base surface (50) of from 0.2 mm to 4 mm, preferably from 0.5 mm to 1.5 mm. In addition, such patterns gently smooth out and deform the fibrous structure of the fabric being treated, and help spread the liquid detergent composition uniformly over the stain.

Scrubbing Region:

The pretreatment cup (10) may also comprise a scrubbing region (110), wherein the scrubbing region (110) comprises scrubbing protrusions (120). The scrubbing protrusions (120) preferably have a height of from 0.2 mm to 4 mm, more preferably from 0.5 mm to 1.5 mm. Having both a spreading region and a scrubbing region encourages more customers to pretreat using a liquid detergent composition.

To avoid the scrubbing region (110) affecting spreading of the liquid detergent composition by the spreading region (80), the scrubbing region (110) is preferably located on a different plane to the spreading region (80). In a preferred embodiment, the scrubbing region (110) may be located on the exterior wall surface (60), while the spreading region (80) is located on the exterior base surface (50). In another embodiment, both the spreading region (80) and the scrubbing region (110) are located on the exterior base surface (50), with the exterior base surface (50) curved such that the scrubbing region (110) is located on a different plane to the spreading region (80). In yet another embodiment, the exterior base surface (50) is divided into two connected surfaces which are angled relative to each other, with the scrubbing region (110) located onto one surface, and the spreading region (80) located onto the other surface, such that the two regions are located on different planes.

The scrubbing region (80) is preferably at least partially located on the exterior periphery (70), since many customers prefer to use the exterior periphery (70) to apply greater pressure while scrubbing.

To simplify use, and for easy of manufacture, the spreading region (80) and scrubbing region (110) may be connected together. In a preferred embodiment, the spreading region (80) and scrubbing region (110) may contact each other at the exterior periphery (70).

For ease of manufacture the scrubbing protrusions (120) are preferably made from the same material as the spreading protrusions (100). Even more preferred, the entirety of the scrubbing region (110) and the spreading region (80), preferably including the scrubbing protrusions (120) and the spreading protrusions (100), are made from the same material.

Preferred scrubbing protrusions (120) include: lines, dots, and mixtures thereof. Preferably, the scrubbing protrusions (120) have a pattern with a parallel orientation. Preferably, the pattern is selected from the group consisting of: one or more lines, one or more curves, and mixtures thereof.

In other embodiments, a spreading region (80) is present and no scrubbing region (110) is present. Such embodiments are particularly suited for delicate fabrics such as silk, satin, and rayon, where vigorous scrubbing may damage the fibres or the fabric weave.

Differentiation of the Pretreating Regions:

It has been surprisingly discovered that emphasizing the pretreatment benefits of the pretreatment cup (10) encourages the customer to use the pretreatment cup (10) for pretreating fabric stains. Therefore, it is preferred that a pretreating region selected from: the spreading region (80), the scrubbing region (120), and mixtures thereof, is differentiated from at least part of the remaining combined area of the exterior base surface (50) and the exterior wall surface (60) by a difference in: material, colour, translucency, surface texture, a line, and mixtures thereof. More preferably, the pretreating region is differentiated from at least part of the remaining combined area of the exterior base surface (50) and the exterior wall surface (60) by a difference in: material, colour, translucency, a line, and mixtures thereof. Most preferably, the pretreating region is differentiated from at least part of the remaining combined area of the exterior base surface (50) and the exterior wall surface (60) by a difference in: colour, translucency, and mixtures thereof.

For greater emphasis, the pretreating region can be differentiated from at least part of the remaining combined area of the exterior base surface (50) and the exterior wall surface (60) by at least two differences selected from differences in: material, colour, translucency, surface texture, a line, and mixtures thereof.

Preferably, the pretreating region is differentiated from at least 25%, preferably 50%, more preferably 75% of the remaining combined area of the exterior base surface (50) and the exterior wall surface (70).

It is believed that such differentiation helps to guide the customer to intuitively select the correct surface for use in pretreating. Surprisingly, the effect is greater when at least part of the pretreatment cup is opaque. In particular, when at least part of a pretreating region selected from the group consisting of: a spreading region (80), a scrubbing region (110), and mixtures thereof, is opaque, more preferably when all of the pretreating region is opaque. A material is defined as "opaque" when the material has a measured translucency of less than 30%, preferably less than 20%, more preferably less than 10% (using the method enclosed herein for measuring transparency/translucency). A material is defined as "transparent" when the material has a measured translucency of greater than 50%, preferably greater than 60%, more preferably greater than 70%, most preferably greater than 80%.

For similar reasons, if both a spreading region (80) and a scrubbing region (110) are present, the spreading region (80) can be differentiated from the scrubbing region (110) by: a difference in material, a difference in colour, a difference in translucency, a difference in surface texture, a line, and mixtures thereof. The scrubbing protrusions (120) of the scrubbing region (110) typically also have a different pattern from that of the spreading protrusions (100) of the spreading region (80). The scrubbing protrusions (120) are preferably oriented differently from the spreading protrusions (100), or are a different shape, or have both a different orientation and a different shape. It is also believed that such a pretreatment cup leads to an increased perception by the customer that the liquid detergent composition and the pretreatment cup are effective together for pretreating stains, even hydrophobic stains such as grease. While the scrubbing protrusions (120) and the spreading protrusions (100) are preferably made from the same material, they can be also be made from different materials, for example, having different hardness. In such embodiments, the scrubbing protrusions (120) can be made from a more deformable material that can deform over the fabric during pretreating. Such deformable materials are gentler on the fabric during scrubbing. Suitable materials include: thermoplastic elastomers, rubbers, and mixtures thereof. Thermoplastic elastomers are preferred.

Liquid Detergent Composition:

Liquid detergent compositions as described herein include flowable liquid detergent compositions for treating fabrics. Such compositions are often referred to as liquid laundry detergent compositions. As used herein, "liquid laundry detergent composition" refers to any laundry treatment composition comprising a fluid capable of wetting and cleaning fabric e.g., clothing, in a domestic washing machine. The liquid detergent composition can include solids or gases in suitably subdivided form, but the overall composition excludes product forms which are non-fluid overall, such as tablets or granules.

For improved pretreatment benefit, the liquid laundry detergent composition comprises a soil removal ingredient, selected from the group consisting of: a surfactant system; an enzyme; a soil release or soil suspension polymer; and mixtures thereof.

Liquid laundry detergent compositions for use in pretreating typically comprise from 1% to 70%, preferably from 5% to 60%, more preferably from 10% to 50%, and most preferably from 15% to 45% by weight of a surfactant selected from the group consisting of: anionic, nonionic surfactants and mixtures thereof. The preferred ratio of anionic to nonionic surfactant is from 100:0 (i.e. no nonionic surfactant) to 5:95, more preferably from 99:1 to 1:4, most preferably 5:1 to 1.5:1.

The liquid laundry detergent composition preferably comprises from 1 to 50%, more preferably from 5 to 40%, most preferably from 10 to 30% by weight of one or more anionic surfactants. For improved grease removal, levels of up to 30%, more preferably from 1 to 15%, most preferably from 2 to 10% by weight of one or more nonionic surfactants is preferred.

Surfactant systems having a high HIc of from 8.0 to 9.2, preferably from 8.2 to 9.1, more preferably from 8.4 to 9.0, are better able to lift and disperse stains, particularly greasy stains. Preferably, such surfactant systems comprise surfactants selected from the group consisting of: non-soap anionic, nonionic, amphoteric, amine, poly hydroxyl fatty acid amines, and mixtures thereof. Particularly preferred are anionic surfactants, nonionic surfactants, and mixtures thereof.

The relative hydrophilicity of a surfactant system is given by the Hydrophilic Index (HIc), as detailed in WO 00/27958:

$$HIc=\Sigma_y(\text{weight \% of surfactant y in the surfactant system})\times HI_{sy},$$

wherein HIsy is calculated for each of the surfactants as follows:

$$HIsy=20\times(\text{the molecular weight of the hydrophilic portion of surfactant component y})/(\text{the molecular weight of the surfactant component y})$$

For the purposes of calculating the Hydrophilic Index, fatty acids are not considered as surfactants. Fatty acids are, however, preferred for use in liquid laundry detergent compositions in combination with the pretreatment cup of the present invention. Especially preferred is rapeseed fatty acid. Other suitable fatty acids include saturated and/or unsaturated fatty acids obtained from natural sources or synthetically prepared. Examples of suitable fatty acids include capric, lauric, myristic, palmitic, stearic, arachidic, and behenic acid. Other suitable fatty acids include palmitoleic, oleic, linoleic, and ricinoleic acid. The fatty acid is preferably present at a level of from 2% to 15% by weight of the liquid laundry detergent composition.

The surfactant systems of the present invention preferably comprise linear alkyl benzene sulphonates and may also comprise other anionic surfactants such as, alkyl sulphates, alkyl polyethoxylate sulphates and mixtures thereof. The detergent compositions of the present invention may contain other non-soap anionic surfactants. Generally speaking, anionic surfactants useful herein are disclosed in U.S. Pat. Nos. 4,285,841, 3,919,678, and WO 00/27958.

Suitable nonionic surfactants are disclosed in U.S. Pat. Nos. 3,929,678, 4,285,841, and WO 00/27958. Exemplary, non-limiting classes of useful nonionic surfactants include: C8-C18 alkyl ethoxylates ("AE"), with EO 1-22, including the so-called narrow peaked alkyl ethoxylates and C6-C12 alkyl phenol alkoxylates (especially ethoxylates and mixed ethoxy/propoxy), alkyl dialkyl amine oxides, alkanoyl glucose amides, and mixtures thereof.

The liquid detergent compositions of the present invention may comprise from 0.0001% to 8% by weight of a detersive enzyme which provides cleaning performance. Suitable enzymes include proteases, amylases, lipases, xyloglucanases, pectate lypases, mannanases, bleaching enzymes, cutinases, and mixtures thereof. A preferred enzyme combination comprises a cocktail of conventional detersive enzymes such as lipase, protease, and amylase. Detersive enzymes are described in greater detail in U.S. Pat. No. 6,579,839.

The liquid detergent compositions may optionally contain from 0.01 to 10% by weight of one or more soil release or soil suspension polymer that provide for broad-range soil cleaning of surfaces and fabrics and/or suspension of the soils. Useful polymers are described in US 2009/0124528A1. Non-limiting examples of useful categories of soil release or soil suspending polymers include: amphiphilic alkoxylated grease cleaning polymers; clay soil cleaning polymers; soil release polymers; and soil suspending polymers.

If the viscosity of the liquid detergent composition is too high, then penetration of the composition into the fabric is less effective. If the viscosity is too low, the liquid detergent compositions may either pass straight through the fabric before it can be spread by the pretreatment cup, or is difficult to spread in a controlled manner. Therefore the liquid laundry detergent composition preferably has a flow viscosity, $V_f$, of from 10 cps to 2,000 cps, more preferable from 100 cps to 1,500 cps, most preferably from 200 cps to 700 cps, as measured at 20 $s^{-1}$ and 21° C., and a low shear rate neat viscosity, $V_1$, of from 100 cps to 100,000 cps, more preferably from 1,000 cps to 30,000 cps, most preferably from 2000 cps to 15,000 cps, as measured at 0.5$s^{-1}$ and 21° C. Such a viscosity profile results in more effective spreading of the liquid laundry detergent composition over the stain.

Method of Laundering Fabrics:

The pretreatment cup of the present invention is suitable for pretreating a variety of stains, and is useful for improving the removal of tough stains, even under tough conditions.

The methods of laundering fabrics, of the present invention, comprise the following steps:

a) applying a portion of a liquid laundry detergent composition to the fabric, wherein the liquid laundry detergent composition comprises a soil removal ingredient, selected from the group consisting of: a surfactant system; an enzyme; a soil release or soil suspension polymer; and mixtures thereof;

b) spreading and pressing the liquid laundry detergent composition into the fabric using the spreading region (80) of a pretreatment cup according to any preceding claims; and c) washing the fabric in a laundry washing machine.

The methods of the present invention are particularly suitable for delicate fabrics selected from the group consisting of: elastane, lycra, spandex, polyamide, viscose, rayon, acrylic, silk, and mixtures thereof, more particularly for: viscose, rayon, silk, and mixtures thereof. Preferably, methods for laundering delicate fabrics do not include scrubbing. As such, pretreatment cups that are specifically sold for methods and use with delicate fabrics preferably do not comprise a spreading region.

Stains are particularly hard to remove during cold water washing, such as is often required for delicate fabrics. Therefore, the methods disclosed herein, are suitable for improving stain removal, wherein the fabrics are washed in a laundry washing machine at temperatures from 5° C. to 30° C., more preferably at room temperature (from 10° C. to 20° C.).

Methods:

A) Transparency/Translucency Measurements:

The translucency of a material is measured using the following procedure, using an X-Rite SP-64 Spectrophotometer:

1) Cut out a piece of a relatively flat portion of the bottle. The piece must be able to fit into the base calibration portion (also known as the 'shoe' of the X-Rite SP-64 Spectrophotometer. Clean the sample with a lint free cloth, taking care not to scratch the surfaces.
2) Calibrate the X-Rite SP-64 Spectrophotometer, using the "White reference" and "Black reference", following the procedure in the manual.
3) Select the "Opacity" option from the menu of the X-Rite SP-64 Spectrophotometer, and measure the opacity of the sample, using the "8 mm" aperture size: following the relevant procedure in the instruction manual, take a reading over the Black spot on the shoe, and then a reading over the White spot on the shoe. Repeat the measurement twice, and average the three readings to give the "% opacity".
4) The % translucency is calculated as: 100-% opacity.

B) Viscosity Measurements:

The viscosity of fluid detergents herein, namely $V_n$, and $V_d$, is measured using a TA AR550 Rheometer, manufactured by TA Instruments Ltd. The software used is provided with the instrument and called "Rheology Advantage Instrument Control AR".

The instrument is set up before each measurement according to the instructions reported in the Manual "AR550 Rheometer Instrument and accessory manual" (January 2004, PN500034.001 rev F) p 25-29, 40-44, and the Manual "Rheology advantage Instrument Control Getting Started Guide" (January 2004, Revision E) p 9-14, 20, 25-28, 37-38. The settings and parameters used are described herein.

In the "Geometry" section of the software (see Rheology advantage Instrument Control Getting Started Guide" (January 2004, Revision E) p 9), the gap between the rotating plate (40 mm steel plate) and the sample platform (Peltier plate) is set at 500 microns. The procedure is a continuous ramp test, i.e. a procedure in which the rheology of the sample is measured versus increasing shear rate. The setting for the shear rate ranges from 0.04 $s^{-1}$ to 30 $s^{-1}$ with a total duration of 3 minutes for the continuous ramp test, and sampling of 20 points per each tenfold increase in shear rate (automatically done), providing in total 60 measurements. The measurements are made at a temperature of 21° C.

A 5 ml sample of the liquid laundry detergent composition to be tested is loaded into the rheometer using a loading procedure as described herein. The sample loading procedure (as described in detail in the manual) is as follows:

1. The measurement temperature is set to 21° C. (see "instrument status" section), using the procedure outlined in the instruction manual.
2. The sample is loaded using a plastic pipette with a minimum diameter of 4 mm at the tip (to minimize the impact of the stress carried out by the loading action on the rheology of the sample). A 5 ml sample is applied to the center of the pettier plate, to assure full product coverage of the rotating plate.
3. The rotating plate (plate connected to the measuring system) is brought to the set distance (as defined above).
4. The excess of sample (i.e. any sample that may be around the edges of the rotating plate) is removed with a spatula assuring correct loading of the sample according to the description in the manual.

The measurement steps are as follows:

5. After the sample is loaded, it needs to be left for 10 seconds at rest. The run is started, while making sure the equipment is not exposed to vibrations during the measurement, as this will affect the results. In the case that the measurement is influenced by vibrations, the experiment is repeated whilst excluding the source of vibration.
6. At the end of the run the program stops automatically. All viscosity data are automatically saved.
7. The plates are cleaned with water and ethanol and then dried with paper towel.

EXAMPLES

Example 1

The efficacy of a spreading region (80) of a pretreatment cup (10) was evaluated using the procedure described herein. The pretreatment cup (10) comprised a spreading region (80) on the exterior base surface (50). The spreading region (80) had a circular shape of diameter 48 mm, with spreading protrusions (100) that consisted of uniformly spaced radial lines of length ranging from 4 mm to 12 mm, a maximum width of 2 mm, and a height of 1 mm. The spreading region (80), including the spreading protrusions (100), is made from polypropylene.

The efficacy of the spreading region of the pretreatment cup was evaluated on dried tea stains, having a diameter of from 5 to 7 cm, on cotton test fabrics (supplied by Habeco, Buisson 28, 6983 Ortho, Belgium).

2 ml of Western European Ariel liquid laundry detergent composition was applied to each stain, using a 5 ml syringe, and spread gently using the spreading region of the pretreatment cup, applying minimal force. The stained test fabrics were left for 5 minutes, before being washed by placing in a 3L beaker with 2.5L of water at a temperature of 50° C. and stirring with a stirring rod for 30 s. The fabric was then rinsed by adding the fabric to a bottle containing 0.4L of water at 50° C., and vigorously shaking the bottle for 10 s. The test fabrics were then transferred to a dry table and left to dry.

The test fabrics were graded by two expert graders on a scale of 0 to 4, versus the control (fabrics prepared using the same procedure, but without spreading the stain with the spreading region of the pretreatment cup). The following psu softness grading scale was used:

0—I see no difference
1—I think I see a difference
2—I know I see a difference
3—I see a big difference
4—I see a very big difference The test was repeated over 2 replicates, and the results averaged. The test fabrics that were treated with the spreading region (80) of the pretreatment cup (10), showed significantly less stain remaining, with a 2.5 psu improvement in stain removal, in comparison with the control.

The test was repeated using polycotton (supplied by Dewerchin, Deken Degryselaan 25, 8500 Kortrijk, Belgium), and 1.6 ml of Western European Ariel liquid laundry detergent composition. A benefit of 2 psu was observed from using the spreading region (80).

Example 2

A liquid laundry detergent composition that is suitable for use in combination with the pretreatment cup of the present invention:

| Wt % | Example.1 |
|---|---|
| C12-14 alkyl polyethoxylate (3.0) sulfate | 1.2 |
| C11.8 linear alkylbenzene sulfonc acid | 10 |
| C14-15 alkyl 7-ethoxylate | 6 |
| C12-14 alkyl 7-ethoxylate | 1 |
| Citric Acid | 3 |
| C12-18 Fatty Acid | 2.6 |
| Protease (54.5 mg/g/)[1] | 0.4 |
| Mannaway 25 L (25 mg/g)[2] | 0.06 |
| Natalase 200 L (29.26 mg/g)[2] | 0.09 |
| Whitezyme (20 mg/g)[2] | 0.06 |
| Termamyl Ultra (25.1 mg/g)[2] | 0.05 |
| Pectwash (20 mg/g) | 0.09 |
| Zwitterionic ethoxylated quaternized sulfated hexamethylene diamine[3] | 0.6 |
| Diethylene Triamine Penta Methylene Phosphonic acid | 0.4 |
| PEG-PVAc Polymer[4] | 1 |
| Grease Cleaning Alkoxylated Polyalkylenimine Polymer[5] | 0.2 |
| brightener | 0.1 |
| Hydrogenated Castor Oil | 0.4 |
| Ethanol | 1 |
| 1,2 propanediol | 4 |
| Na formate | 0.20 |
| $CaCl_2$ | 0.05 |
| mono ethanol amine | 0.5 |
| Na cumene sulphonate | 1 |
| C12-14 alkyl polyethoxylate (3.0) sulfate | 1.2 |
| C11.8 linear alkylbenzene sulfonc acid | 10 |
| C14-15 alkyl 7-ethoxylate | 6 |
| NaOH | Up to pH 8 |
| Water & minors | Up to 100% |

[1]Available from Genencor International, South San Francisco, CA.
[2]Available from Novozymes,, Denmark.
[3]Described in WO 01/05874 and available from BASF (Ludwigshafen, Germany)
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).
[5]600 g/mol molecular weight polyethylenimine core with 24 ethoxylate groups per —NH and 16 propoxylate groups per —NH. Available from BASF (Ludwigshafen, Germany).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of laundering fabrics, comprising the following steps:

a. applying a portion of a liquid laundry detergent composition to the fabric, wherein the liquid laundry detergent composition comprises a soil removal ingredient, selected from the group consisting of: a surfactant system; an enzyme; a soil release or soil suspension polymer; and mixtures thereof;

b. spreading and pressing the liquid laundry detergent composition into the fabric using a spreading region of a pretreatment cup; and c. washing the fabric in a laundry washing machine;

wherein said pretreatment cup comprises:

a base comprising an exterior base surface;

a wall comprising an exterior wall surface; and an opening circumscribed by a rim, wherein the opening is at least partially opposite the base;

wherein the exterior base surface is connected to the exterior wall surface at an exterior periphery;

characterized in that:

a surface selected from the group consisting of: the exterior base surface, the exterior wall surface, and mixtures thereof, comprises said spreading region, wherein the spreading region comprises one or more spreading protrusions, wherein the spreading protrusions are arranged in a pattern selected from the group consisting of: radial, concentric, spiral, or mixtures thereof;

wherein the spreading region has a curvature such and a centre of mass such that when the pretreatment cup is positioned with the centre of mass of the spreading region on a non-deformable surface, the pretreatment cup can be tilted a maximum of about 45° before the spreading region is no longer in contact with the non-deformable surface.

2. The method according to claim 1, wherein the spreading protrusions are selected from the group consisting: of lines, dots, and mixtures thereof.

3. The method according to claim 1, wherein the spreading protrusions have a height from the exterior base surface of from about 0.2 mm to about 4 mm.

4. The method according to claim 1, wherein the spreading protrusions comprise lines having a length of from about 2 mm to about 40 mm.

5. The method according to claim 1, wherein the spreading protrusions comprise lines having a length of from about 4 mm to about 15 mm.

6. The method according to claim 1, wherein the spreading protrusions comprise dots having a width of from about 0.2 mm to about 5 mm.

7. The method according to claim 6, wherein the spreading protrusions comprise dots having a width of from about 1 mm to about 3 mm.

8. The method according to claim 1, wherein the spreading region has a curvature such that when the pretreatment cup is positioned with the centre of mass of the spreading region on a non-deformable surface, the pretreatment cup can be tilted a maximum of about 30° before the spreading region is no longer in contact with the non-deformable surface.

9. The method according to claim 8, wherein the spreading region has a curvature such that when the pretreatment cup is positioned with the centre of mass of the spreading region on a non-deformable surface, the pretreatment cup can be tilted a maximum of about 15° before the spreading region is no longer in contact with the non-deformable surface.

10. The method according to claim 1, wherein the spreading protrusions are made from a material having a hardness, as measured on the Rockwell scale (ISO 2039-2), of from about 50 to about 150.

11. The method according to claim 10, wherein the spreading protrusions are made from a material having a hardness, as measured on the Rockwell scale (ISO 2039-2), of from about 65 to about 85.

12. The method according to claim 1, wherein the spreading region is made from a material that comprises polypropylene.

13. The method according to claim 1, wherein the spreading region is at least partially located on the exterior base surface.

14. The method according to claim 1, further comprising a scrubbing region, wherein the scrubbing region comprises scrubbing protrusions.

15. The method according to claim 14, wherein the scrubbing protrusions are made from the same material as the spreading protrusions.

16. The method according to claim 15, wherein the scrubbing region is at least partially located at the exterior periphery.

17. The method according to claim 15, wherein the scrubbing region is located at least partially on a different plane to the spreading region.

18. The method according to claim 14, wherein the region selected from: the spreading region, the scrubbing region, and mixtures thereof, is differentiated from at least part of the remaining combined area of the exterior base surface and the exterior wall surface by by a difference in: material, colour, translucency, surface texture, a line, and mixtures thereof.

* * * * *